United States Patent [19]

Hill

[11] Patent Number: 4,884,764

[45] Date of Patent: Dec. 5, 1989

[54] YARN WINDING MACHINE

[75] Inventor: Grenville M. Hill, Greenisland, Northern Ireland

[73] Assignee: James Mackie & Sons Limited, United Kingdom

[21] Appl. No.: 238,986

[22] Filed: Aug. 24, 1988

Related U.S. Application Data

[63] Continuation of Ser. No. 62,179, Jun. 12, 1987, abandoned.

[30] Foreign Application Priority Data

Jun. 16, 1986 [GB] United Kingdom ..... 8614605

[51] Int. Cl.[4] ..... B65H 54/28

[52] U.S. Cl. ..... 242/158 R; 242/18 R; 242/25 R; 242/158.2; 242/158.4 R

[58] Field of Search ..... 242/158 R, 158 B, 158 F, 242/158.2, 158.3, 158.4 R, 158.4 A, 25 R, 25 A, 16, 17, 18 R, 18 A, 7.14, 7.15, 7.16, 43 R

[56] References Cited

U.S. PATENT DOCUMENTS

| | | | |
|---|---|---|---|
| 2,629,560 | 2/1953 | Abbe | 242/43 R |
| 3,498,567 | 3/1970 | Baker et al. | 242/158.4 R |
| 3,747,861 | 7/1973 | Wagner et al. | 242/43 R |
| 3,951,355 | 4/1976 | Morioka et al. | 242/158 R |
| 3,997,128 | 12/1976 | Hara et al. | 242/158 R X |
| 4,143,833 | 3/1979 | Hara et al. | 242/158 R |
| 4,143,834 | 3/1979 | Hara et al. | 242/158 R |
| 4,150,801 | 4/1979 | Ikegami et al. | 242/158 R |
| 4,421,284 | 12/1983 | Pan | 242/158 R |
| 4,592,521 | 6/1986 | Hallikas et al. | 242/158 R |
| 4,784,341 | 11/1988 | Hill et al. | 242/18 A |

FOREIGN PATENT DOCUMENTS

| | | | |
|---|---|---|---|
| 48770 | 4/1977 | Japan | 242/158 R |
| 141479 | 12/1978 | Japan | 242/158.2 |
| 557219 | 11/1943 | United Kingdom . | |
| 1002570 | 8/1965 | United Kingdom . | |
| 1356335 | 6/1974 | United Kingdom . | |
| 1403918 | 8/1975 | United Kingdom . | |
| 1434916 | 5/1976 | United Kingdom . | |
| 2127860 | 4/1984 | United Kingdom . | |

*Primary Examiner*—Stanley N. Gilreath

*Attorney, Agent, or Firm*—Wood, Herron & Evans

[57] ABSTRACT

This invention relates to yarn winding apparatus having a split traverse yarn guide. The yarning winding apparatus includes a mechanism to control the position of the traverse yarn guide relative to the axis of the package being wound so as to maintain a small gap between the traverse guide and the package surface during package formation. No part of the mechanism contacts the package surface.

15 Claims, 5 Drawing Sheets

YARN WINDING MACHINE

Figure 1:
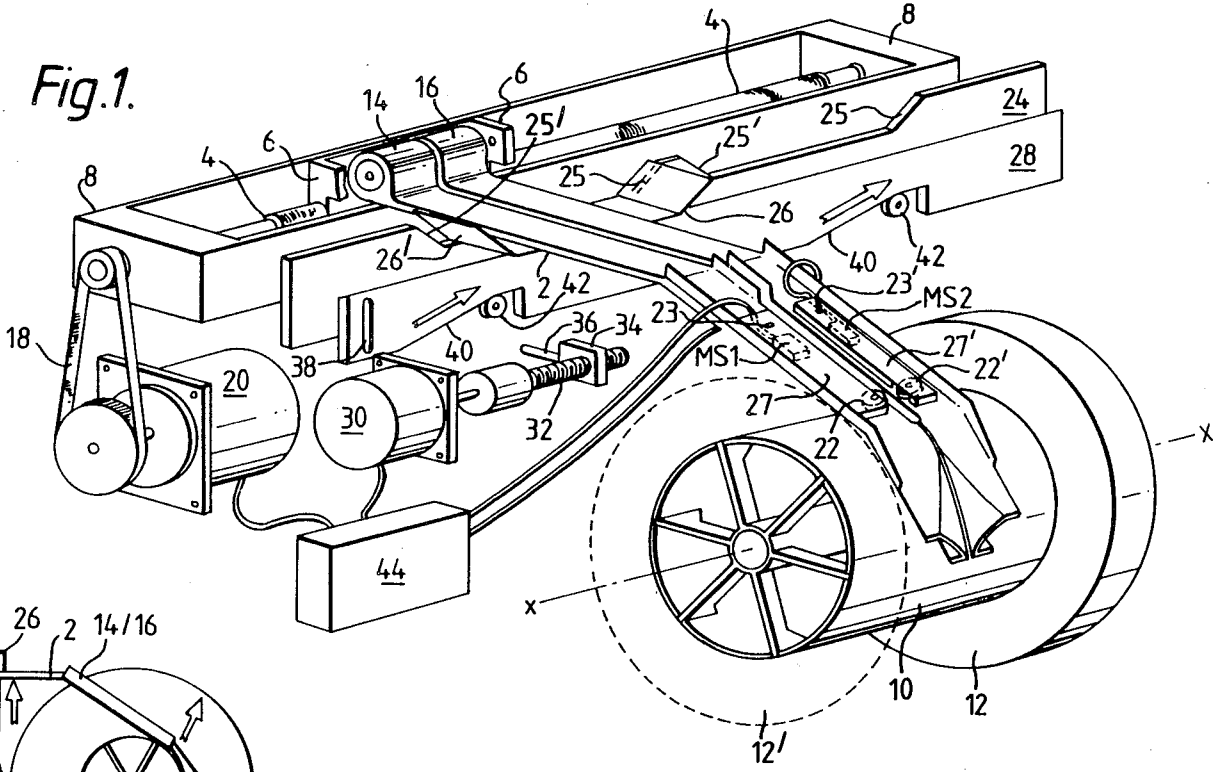

This application is a continuation of application Ser. No. 062,179 filed June 2, 1987, now abandoned.

IMPROVEMENTS IN AND RELATING TO YARN WINDING MACHINES

This invention relates to yarn winding apparatus. By the term "yarn" we wish to include natural and synthetic yarns and filaments as well as wire.

Existing winders include a yarn laying mechanism which may, for example, be in the form of a traverse guide screw or cam and a yarn guide which is caused, by engagement of a follower with the screw or cam, to reciprocate or traverse along the length of a yarn package e.g. a bobbin to lay the yarn evenly on the surface of the package. There are various other ways of driving the yarn guide, such as scrolls, cams, belts and chains.

If the bobbin, for example, has end flanges then in order to lay the yarn, which may be in the form of a filament, close to the flanges the guide has to be positioned above the flanges so that it can pass thereover. Hence the length of the yarn from the traverse guide to the surface of the bobbin on which yarn is being laid is significant and can lead to a ridged unevenly wound package. Furthermore the yarn may not be laid close up to the flange of the bobbin with the result that the end windings may fall into a gap between the flange and the end of the windings.

While not being desirable to have too great a distance between the traverse yarn guide and the surface of the bobbin, it is also not desirable to have the traverse guide or associated sensing roller in frictional contact with the bobbin since this also results in an uneven package surface when winding certain materials e.g. fine mono-filament yarns.

If the yarn is wound unevenly unwinding problems due to yarn jerking and sticking may arise causing uneven tension in the yarn being unwound and even yarn breakage.

Such problems are substantially overcome by a yarn winding apparatus in accordance with the invention which comprises a yarn traverse mechanism including a traverse yarn guide which is caused to reciprocate along the length of a bobbin to be wound, to lay the yarn on the bobbin wherein the apparatus includes a mechanism to control the position of the traverse yarn guide relative to the axis of the package being wound so as to maintain a small gap between the traverse guide and the package surface during package formation, no part of the mechanism contacting the package surface.

Thus no sensor or the like is present to impose a drag on the package. The 'small gap' between the yarn guide and the package is, for example, the thickness of the yarn and this gap removes problems caused by frictional drag of the yarn guide on the package. Furthermore the problems which occur if the yarn guide is significantly spaced from the package surface are avoided because of the structure of the yarn guide itself.

Preferably, the yarn guide is split to have two independently displacable fingers between which yarn is positioned. The relatively trailing part or finger in any particular stroke of the guide acts to cause the yarn to be moved fully to the flange of the bobbin because means are provided to displace the relatively leading guide finger on any particular stroke at or prior to the leading finger reaching the flange of the bobbin so that the trailing portion can reach, and lay yarn right up to, the flange.

The leading finger may be pivoted or retracted straight back from the bobbin but, preferably it is raised so as to enable it to clear the flange.

The means for lifting a guide finger may for example comprise a cam positioned on the winder adjacent each flange on the body which engages the relatively leading guide finger and which acts to pivot the leading guide finger upwardly at a position close to the flange so that that guide finger may pass over the top of the flange.

Alternatively the guide parts may each be formed or provided with a member to engage the flange of the bobbin in such a way to cause the respective guide part to be lifted over it.

In a further alternative the means may act to rotate the guide about a transverse axis so that the relatively leading finger is lifted as the guide rotates through 90° allowing the other i.e. the trailing finger, to be moved up close to the flange of the bobbin. The guide may, for example, be rotated mechanically at the appropriate part of the traverse, or, alternatively, with such a guide, once it has passed beyond the mid-point of any one stroke, the angle of the yarn between the let off point and the point of laying on the bobbin surface may be such that the tension in the yarn will cause the yarn guide to rotate about a central pivot in effect lowering the trailing part of the guide and raising the leading part of the guide through a sufficient angle as the guide approaches the bobbin flange as to enable it to be pivoted fully to the required position when it engages the obstructing wall of the flange. This avoids other separate guide pivoting means.

Preferably the mechanism for controlling the position of the yarn guide relative to the axis of the package so that the yarn guide is in effect moved away from the axis as the package is being formed so as to maintain the small gap between the guide and the package surface, comprises a standard "stepping" motor which is operated intermittently to lift the yarn guide away from the package axis. The intermittent operation of the motor is preferably achieved by electric signals transmitted from a feeler, the operation of which will be described hereafter, which may, for example, be positioned to engage a flange of a flanged bobbin at the end of each traverse stroke.

The engagement of the flange and feeler causes a signal to be transmitted.

It is not essential that the small gap be present between the yarn guide and package surface throughout the full winding cycle. Apparently if the traverse guide rests on the surface of the package for example for the last few winding layers no noticeable ill-effect will occur. Neither is it essential for the width of the small gap to be maintained constant throughout winding.

Preferably the traverse box containing the screw and follower is maintained in a fixed position. Whilst this is convenient it requires a somewhat longer traverse guide finger and the longer and heavier fingers would increase frictional drag were they to rest on the surface of the package. When ridging of the package occurs this traverse guide would start to bounce significantly altering the yarn tension control and thus further exacerbating ridging. The invention is thus particularly useful for winders having fixed traverse boxes.

As the bobbin increases in diameter with the layers of yarn pressure increases on the flanges to the extent that they may become deformed outwardly and the distance between the flanges is varied. If a fixed traverse distance is employed then yarn could fall into the space at each end of the bobbin. After the bobbin is emptied a certain amount of restoration to its original shape occurs but this varies from bobbin to bobbin and so it is important that the distance of each traverse right from the very first layer is monitored and controlled. As previously mentioned feelers or detectors are provide which may be mounted on each guide finger to detect when the yarn reaches the flange. As well as transmitting a signal to a "stepping" motor to raise the level of the yarn guide relative to the surface of the package, the feeder also signals to the traverse guide mechanism to reverse and return to the opposite flange.

Such detector means may comprise a runner on the inner edge of each guide to contact the adjacent bobbin flange at the end of each traverse stroke when that guide part is the trailing finger and which transmits a signal to reverse the direction of guide drive and operate the "stepping" motor which raises the level of the yarn guide relative to the package surface.

In a preferred embodiment there is a pivotally mounted detector carrying a runner. The runner is rotated by the rotating flange to reduce friction and at the same time, the pressure on the runner causes the detector to pivot to send a signal to reverse the direction of the traverse movement of the yarn guide. Thus by means of this detective system the length of each traverse can vary if the distance between the bobbin flanges varies so that yarn will always be layed right up to the bobbin flange regardless of the thickness of the package.

Figure 2:
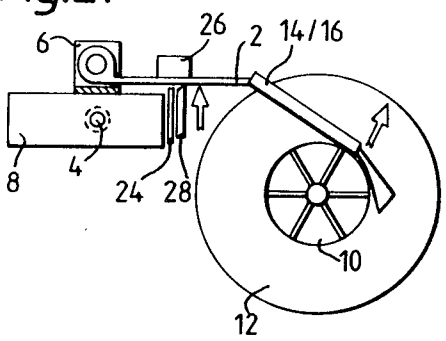
Figure 3:
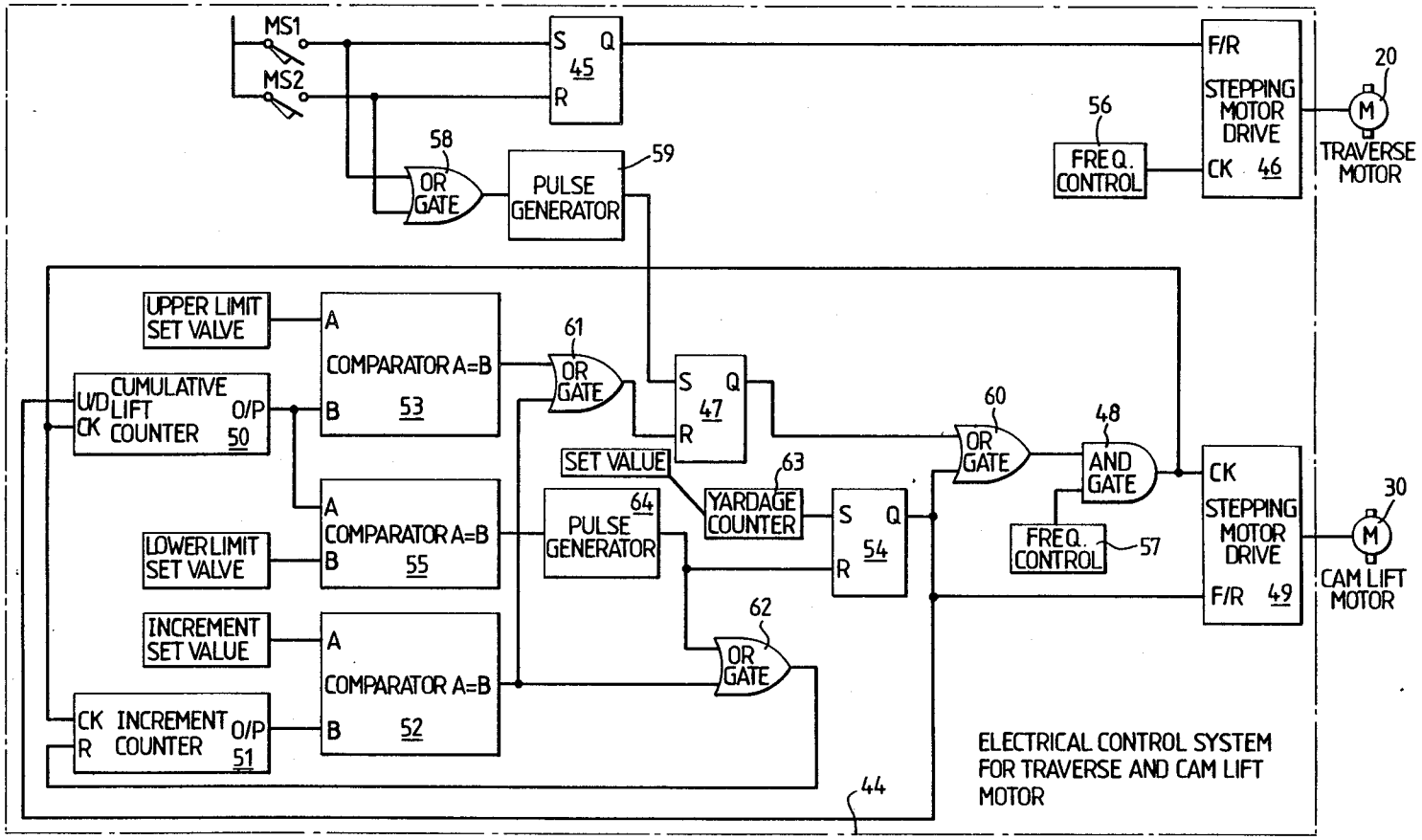
Figure 4A:
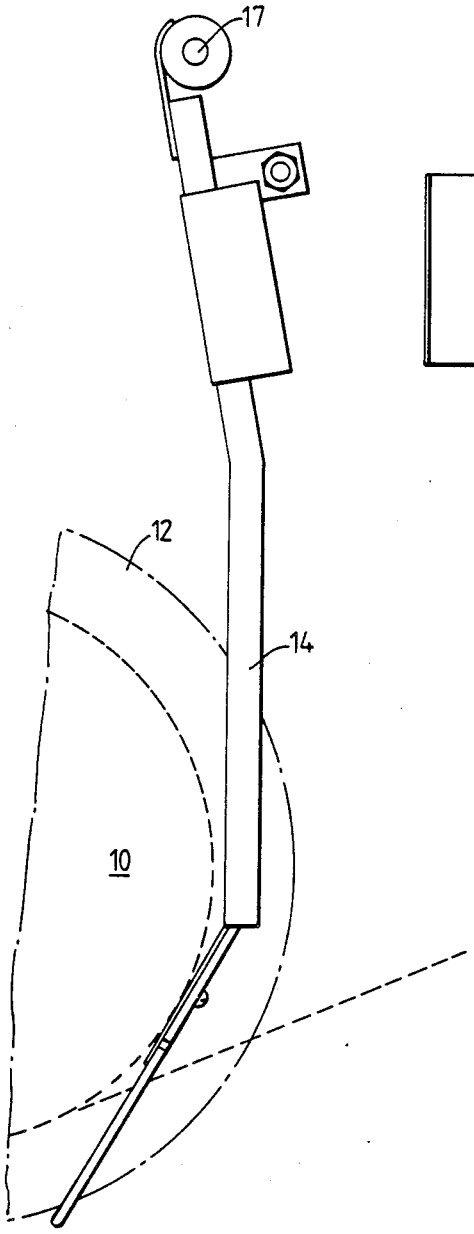
Figure 4B:
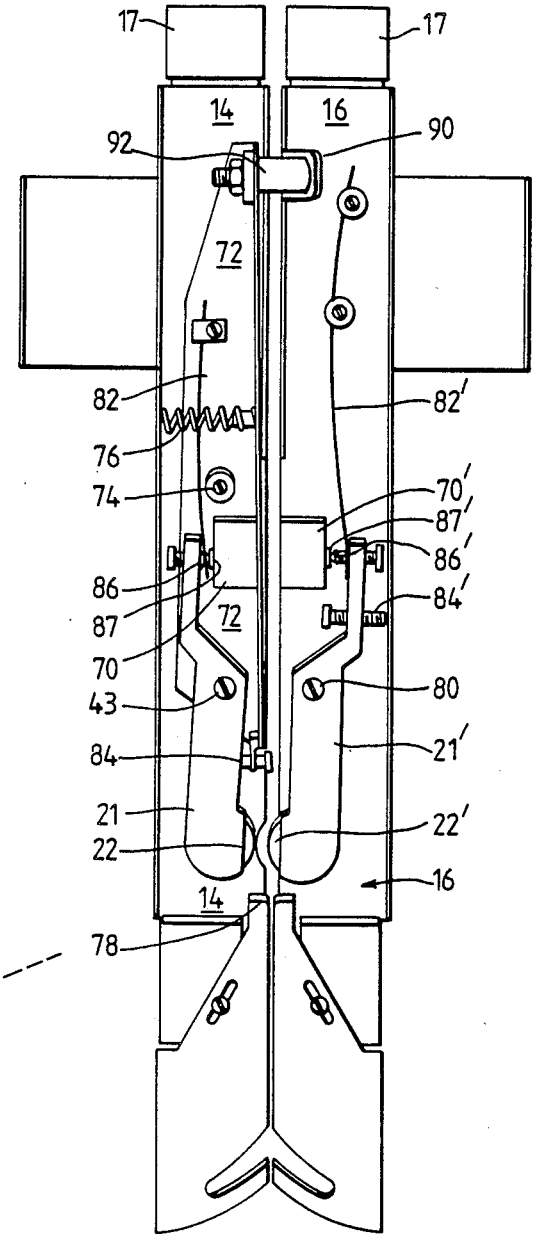
Figure 5A:
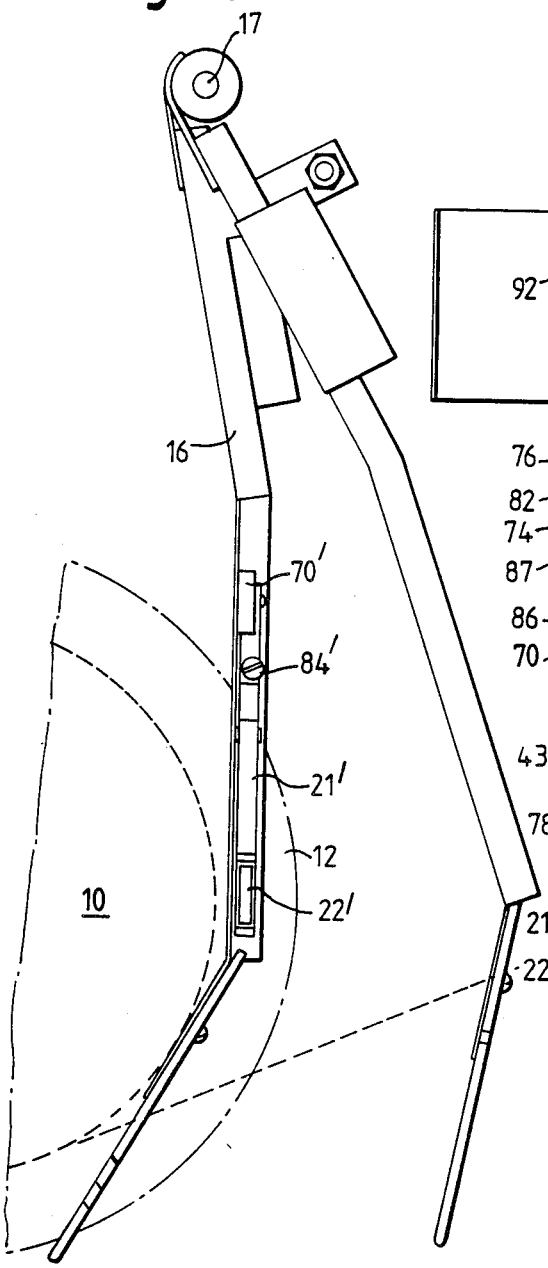
Figure 5B:
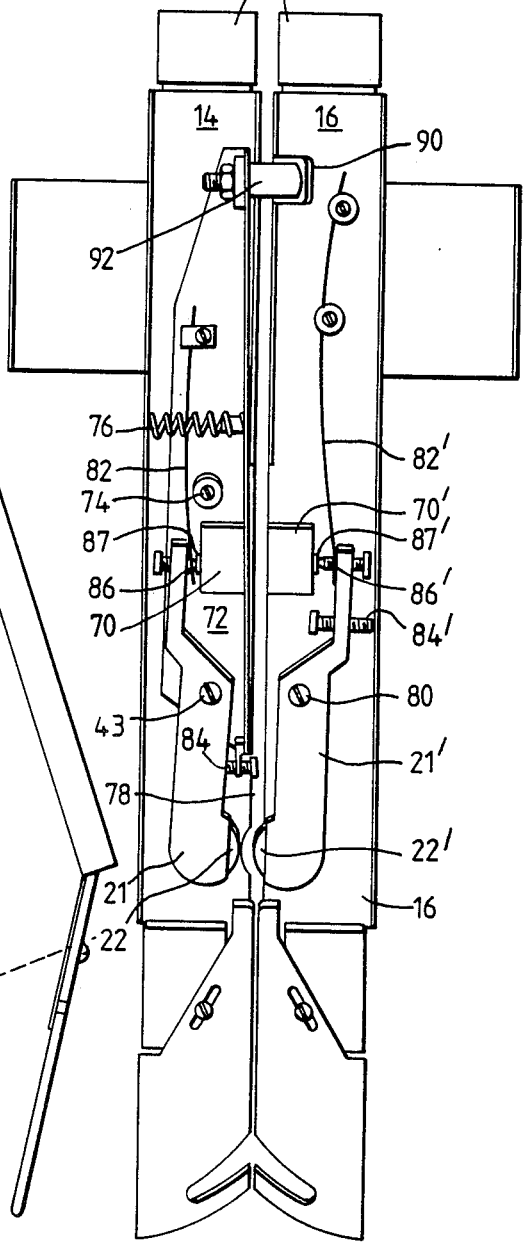
Figure 6A:
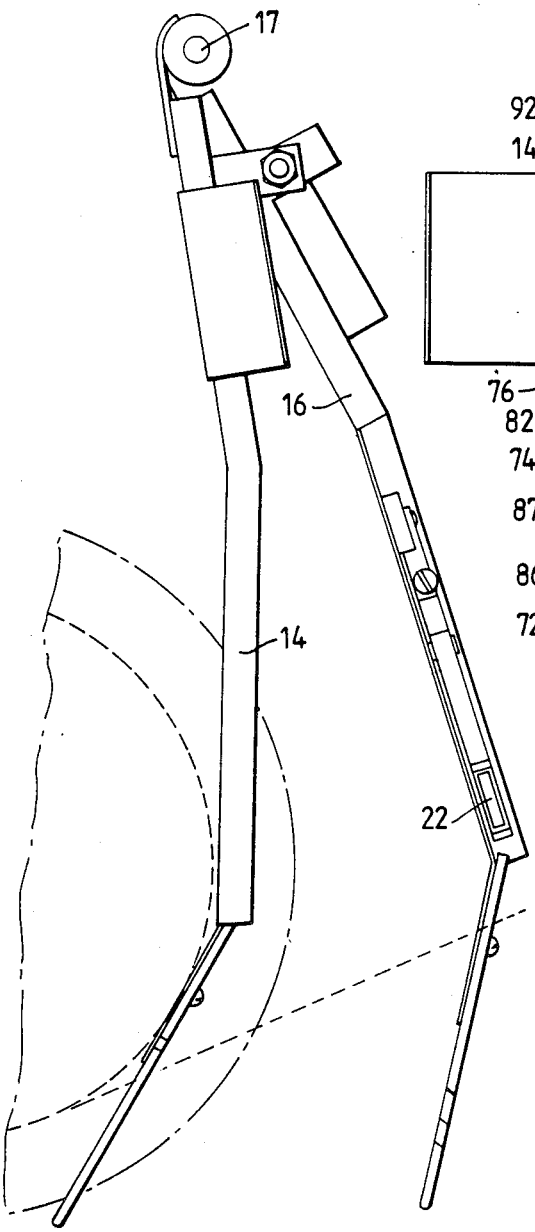
Figure 6B:
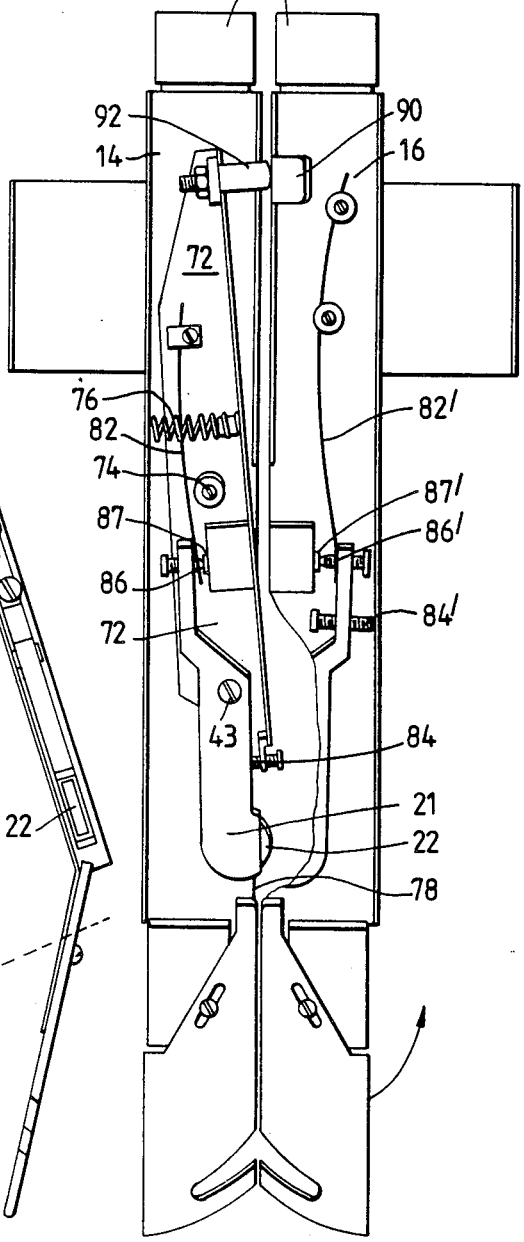

The invention will now be described by way of example with reference to the accompanying drawings in which FIG. 1 is a perspective view of one example of the yarn guide mechanism of a yarn winder in accordance with the invention, FIG. 2 is an end view, to a smaller scale, of part of the mechanism shown in FIG. 1, FIG. 3 is an electrical circuit diagram of the control system of the mechanism for controlling the position of the yarn guide and the direction of reciprocation, FIG. 4*a* is a side view of the yarn guide with an alternate embodiment of the runners in accordance with the present invention, FIG. 4*b* is a plan view of the mechanism shown in FIG. 4*a*, FIG. 5*a* is a side view of the FIGS. 4*a* and 4*b* yarn guide when engaging the left hand bobbin flange as shown in FIG. 1, FIG. 5*b* is a plan view of the mechanism shown in FIG. 5*a*, FIG. 6*a* is a side view of the FIGS. 4*a* and 4*b* yarn guide when engaging the right hand bobbin flange as shown in FIG. 1, and FIG. 6*b* is a plan view of the mechanism shown in FIG. 6*a*.

Referring now to FIG. 1, the yarn laying mechanism of the winder comprises a traverse yarn guide generally indicated at 2 which is pivotally mounted on a threaded block 6 which is caused to reciprocate along co-operating rotating screw 4, the block and screw being mounted in a fixed traverse box 8.

The guide 2 is intended to guide the feed yarn (not shown) onto the barrel of a bobbin 10 provided with flanges 12 and 12'. As can be seen in FIG. 1 the guide 2 is formed of two fingers 14, 16 each pivoted separately to the block 6. The fingers 14 and 16 can thus each hinge upwardly to accommodate the growth of the package. Each finger may be provided with a tungsten carbide tip to help to withstand abrasion of the filament being wound.

In practice yarn is fed between the two fingers 14 and 16 at the end portion of the guide, so as to be reciprocated by the guide along the length of the barrel of the bobbin between the flanges.

The traverse screw 4 is driven through a belt 18 by a standard stepper motor 20. The drive is reversed each time the yarn is fed up to one of the flanges of the bobbin as the yarn guide is reciprocated along the length of the body of the bobbin. This is achieved by means of a runner 22, 22' on supports 27, 27' each pivotally mounted at 23, 23' to a respective finger 14 and 16 of the yarn guide and positioned to engage the inside face of an adjacent bobbin flange 12, 12' each time the yarn is guided up to the respective flange. On such engagement the support 27, 27' is pivoted to engage a microswitch MS1, MS2 also mounted on respective fingers 14, 16 and below the hollowed supports 27, 27' so as to be contacted by the finger when it is pivoted thus transmitting an electrical signal through control box 44.

In use the leading finger 14 or 16 depending upon the direction of movement of the guide, engages a cam face 25, 25' formed on a cam bar 24 so as to raise the leading finger up and over the flange of the bobbin to enable the trailing finger to control movement of the yarn right up to that flange. This feature is fully described and claimed in the specification of our British Pat. No. 2127860.

The movement of the fingers up the cam faces 25, 25' is assisted by wings 26, 26' added to the underside of the traverse guide fingers 14 and 16.

It will thus be appreciated that if the yarn is being traversed along the bobbin from left to right as seen in FIG. 1 the relatively right hand finger 16 is lifted by the right hand cam face 25 so as to clear the right hand bobbin flange 12 and enabling the relatively left hand finger 14 to feed yarn right up to the inside face of the flange.

When the runner 22 engages the inside face of the bobbin flange 12 it transmits a signal through microswitch MS1 and a control box 44 to the motor 20 the motor is caused to reverse its direction so as to feed the yarn guide fingers 14 and 16 back along the barrel of the bobbin from right to left, the procedure being repeated when runner 22' engages the inside face of the bobbin flange 12'.

In order to maintain a small gap between the yarn guide fingers and the surface of the package a lifting bar 28 is provided extending along the length of the traverse path of the yarn guide and is positioned below the fingers 14 and 16. The lifting bar is mounted in guides (not shown) for longitudinal movement parallel to the axis XX of the bobbin. The longitudinal movement of the bar 28 is effected by a cam lift "stepper" motor 30 the spindle of which has a screwed extension 32 engaging in a screwed block 34 having a pin 36 engaging in a slot 38 in one end of the lifting bar 28.

The underside of the bar 28 is formed with cam surfaces 40 which co-operate with support runners 42 fixed to the frame of the winder. Longitudinal movement of the bar 28 from left to right, as shown in the drawings, is caused by rotation of the screwed bar 32 by the motor 30 and results in the bar 28 riding up the runners 42 so that the bar is moved upwards in a vertical direction relative to the axis XX of the bobbin. Because of the engagement of the top of the bar 28 with the underside of the wings 26 of the fingers 14 and 16 of the yarn guide these fingers are caused to rise in unison by a predetermined amount each time the "stepper" motor 30 is activated.

The "stepper" motor 30 and motor 20 whose actions are described hereafter are standard units such as are manufactured by The Superior Electric Company of Bristol, Conn., U.S.A. and are in effect permanent magnet motors that convert electrical signals into mechanical motion. Each time a pulse is applied to the motor windings the motor output shaft rotates by a specific angular distance.

The "stepper" motor 30 is operated through a microprocessor or control unit 44, as illustrated in FIG. 3 with an increment counter 51 which is preset in accordance with the thickness of the yarn and which is connected through an electric circuit to runners 22, 22' mounted on detectors 21, 21' (shown in FIG. 4*b*) on the yarn guide fingers so that each time one of the runners 22, 22' engages the flange of the bobbin, to reverse the direction of the traverse guide, it sends a signal through the counter to provide the desired number of pulses to activate the "stepper" motor 30 and rotate the screwed extension 32 by a predetermined amount which determines the axial travel of the screwed block 34 and hence the distance by which the bar 28 lifts the guide fingers 14, 16.

At the start of operation the traverse guide is set in conjunction with the counter so as to leave a very small gap which may be approximately equivalent to the thickness of the yarn filament, between the barrel of the bobbin and the underside of the traverse guide.

FIG. 3 illustrates the electric circuitory controlling the traversing movement of the yarn guide 2 axially of the bobbin and its pivotal movement outwardly from the axis.

When runner 22, 22' engages the bobbin flange 12, 12' the microswitch MS1, MS2 is contacted by the runner support 27, 27' which is pivotally mounted on the yarn guide finger 14, 16. Contact with the microswitch sends an electrical signal to the input terminals R, S of a flip flop 45 the output Q of which is connected to the forward/reverse (F/R) of the input terminal of the stepping motor drive 46.

Operation of the microswitch MS1 results in the transmission of a signal to the stepping motor 20 to cause it to rotate in a direction to drive the traverse guide to the left, as seen in FIG. 1, and engagement of microswitch MS2 results in the stepping motor 20 being reversed so as to drive the yarn guide to the right.

The speed of the traverse motor 20 is governed by a frequency fed in the form of a pulse train to the input terminal CK of the stepping motor drive 46 from the adjustable frequency generator 56. Receipt of a signal from the frequency generator by the stepping motor is mandatory for transmission of a supply voltage sequence to the traverse motor 20 and is set so that the frequency signal is uninterrupted and the traverse motor operation is continuous.

The speed of the cam lift motor 30 which controls the movement of the yarn guide outwardly from the axis of the package during winding, is governed by a frequency fed to the input terminal CK of the stepping motor drive 49 from the adjustable frequency generator 57. The motor 30 operates only whilst this frequency is received by the stepping motor drive 49 and this is also dependent on the receipt of signals from microswitches MS1 and MS2 respectively when they are operated by the runner 22, 22' engaging the inside face of the bobbin flange at each end of the traverse of the yarn guide. Operation of either of the microswitches transmits a signal through "OR" gate 58, pulse generator 59, flip flop 47 and "OR" gate 60 to "AND" gate 48. The other input terminal at "AND" gate 48 is connected to the adjustable frequency generator 57 and the "AND" gate 48 acts as a switch to allow the signal from the frequency generator 57 to be transmitted to the stepping motor drive 49 so as to operate motor 30, when either of the microswitches MS1, MS2 are engaged.

The input frequency signal to the stepping motor drive 49 is also fed to the input terminals of the lift and increment counters 50 and 51 respectively. These counters totalise the number of pulses received at input terminals CK and continually register the cumulative value at output terminals O/P.

The increment counter 51 establishes the amount by which the yarn guide lifts after each traverse and the lift counter 50 establishes the positional height of the guides at any instant.

The output signal from the increment counter 51 is registered at terminal B of a comparator 52 and when it reaches the predetermined set value A=B, the set value being the number of pulses to the motor required to lift the guides by the predetermined amount, the output signal of the comparator is fed via "OR" gate 61 to set the input terminal R of flip flop 47 thereby changing the signal to "AND" gate 48 hence stopping cam lift motor 30. The output signal from comparator 52 is also fed via "OR" gate 62 to reset input terminal R of the increment counter 51 which resets the output register value to zero.

This sequence is repeated each time a microswitch signal is received and is repeated in steps raising the yarn guide until the full package has been wound at which time the signals from the lift counter 50 to comparator 53 reach the predetermined upper limit set value (A=B) to provide an output signal from the comparator via "OR" gate 61 to flip flop 47 "OR" gate 60 and "AND" gate 48, which as described acts as a switch, so as to prevent further operation of the cam lift motor 30.

This state will continue until a yardage counter 63 which registers completion of the full bobbin is reset to zero and sends a signal to set flip flop 54 which via "OR" gate 60 and "AND" gate 48 resets the frequency to stepping motor drive 49 so as to operate motor 30. Flip flop 54 also sends a signal to input terminal F/R of stepping motor drive 49 and input terminal U/D of lift counter 50. This causes the motor 30 to be reversed to lower the yarn guide and lift counter to count down instead of up. The motor 30 operates in this mode until the lower set value of comparator 55 is reached. The output signal from comparator 55 is fed to pulse generator 64 which signals input terminal R of flip flop 54 and also via "OR" gate 62 to reset increment counter 51. The signal transmitted from flip flop 54 to stepping motor drive 49 causes motor 30 to be reversed so as to drive it to lift the yarn guide and the full winding cycle is repeated.

In order to make sure that the length of each traverse stroke of the yarn guide is such as to lay the yarn closely adjacent each bobbin flange, when the runner 22, mounted on detector member 21, engages a flange, it pivots on its guide member. As a result of engaging the flange it transmits a signal to "stepper" motor 30 to move the lifting bar 28, and an electrical signal is transmitted to the second "stepper" motor 20 to reverse the traverse drive mechanism.

In this way, the length of each traverse stroke is determined by the detectors on the guides thus ensuring that the yarn is laid up to the respective flanges. This also obviates the problem which could arise were the bobbin diameter to increase by build up of yarn thereon, causing increased pressure on the flanges which could even cause distortion thereof.

However it will also be appreciated that with the device illustrated in FIG. 1, as a runner is mounted on each finger it is necessary for the runner 22, 22' to be offset on either side of the vertical diametral line of the bobbin so as to avoid contact with each other. This arrangement, however, causes a problem as, depending upon which side of the vertical diametral line the runners make contact with the rotating bobbin flange 12, the runner is subjected to a force tending either to lift it from the package surface or to press it down onto the package surface.

This causes uneven winding adjacent the bobbin flanges and is overcome by the construction shown in FIGS. 4*a*–6*b*.

FIGS. 4*a* and 4*b* show the two guide fingers 14 and 16 lying side by side in their normal position for winding. The detector member 21 of the finger 14 is pivotably mounted at 43 not to the finger itself as is the case with the detector member 21' of the finger 16 but rather to a carrying plate 72 which is itself pivoted at 74 to the finger 14. The mircoswitch device 70 (which corresponds with MS1 of FIGS. 1 and 3) which transmits the signal to the mechanism for reversing the traverse movement is also carried on the plate 72 which is biased by means of a spring 76 to the position shown in FIG. 4*b* in which it is pivoted in a clockwise direction about the pivot 74 to move the runner 22 to an inoperative position away from the inner edge 78 of the finger 14. It can thus be positioned opposite to the corresponding runner 22' of the finger 16 without obstructing the runner 22' when it is in the normal detector position. The runner 22' is not carried on a plate 72 but is rather pivoted about a pivot 80 directly to the finger 16.

Both the detector members 21 and 21' are biased by means of a spring member 82, 82' to a position in which they are held by stop screws 84, 84' with their contacts 86, 86' held apart from the corresponding contacts 87, 87' on switch units 70, 70'. In this position, therefore, both the runners can be located on the diametral line 88.

When the finger 14 approaches the flange 12' of the bobbin at the end of one stroke it is lifted by the cam device, as described with reference to FIG. 1, to a position as illustrated in FIG. 5*a* in which it can clear the flange. The runner 22' then engages the flange and is moved against the bias of a spring 82' in an anti-clockwise direction about its pivot 80 until the contacts 86', 87' close and a signal is transmitted to reverse the traverse movement.

When the yarn guide unit reaches the other flange 12 of the bobbin the finger 16 is pivoted upwardly about pivot 17 as described before so as to be able to clear the corresponding flange 12 of the bobbin.

In so doing a deflecting surface 90, provided adjacent the inner end of the finger 16, engages a stud 92 connected to the inner end of the carrying plate 72 of the finger 14. This stud and hence the plate 72 is moved to the left as shown in FIG. 6*b* as the surface 90 rises, causing the carrying plate 72 to pivot about its pivot 74 to bring the runner 22 into the operative position, as seen in FIG. 6*b*, overlapping the inner edge 78 of the finger 14 so that it can engage the adjacent flange 12 on the diametral line.

On contact with the flange the deflector member 21 is pivoted about its pivot 43 against the bias of the spring 82 in a clockwise direction so that the contacts 86 and 87 engage. This causes the traverse drive to reverse and the "stepping" motor 30 to operate. As the fingers move away from the flange 12 the finger 16 is again lowered to the position shown in FIGS. 4*a* and 4*b* with the result that the carrying plate 72 is pivoted in a clockwise direction about the pivot 74 by the bias provided by the spring 76 with the stud 92 sliding back over the deflecting surface 90 until the position in FIG. 4*b* is again reached.

Thus, textile yarn winding apparatus in accordance with the invention allows yarn to be wound evenly right up to the bobbin flange and no part of the mechanism for controlling the position of the yarn guide outwardly from the surface of the yarn package need contact the surface of the package. Further variations of the apparatus are possible within the scope of the invention.

For example instead of the bar 28 being positioned below the yarn guide to engage the underside of the fingers to lift them, each finger could be formed with an extension on the opposite side of its pivot and the bar 28 could be positioned above the yarn guide and inverted so as to press downwardly on the extensions to raise the yarn guide in increments.

In another modification, instead of a counter being incorporated in the drive to the "stepper" motor 30 for the lifting bar, a proximity switch could be arranged on the traverse guide to obtain a signal from the package surface to operate the "stepper" motor to cause the traverse guide to be raised at the end of each traverse stroke.

Alternatively the motor 30 could be positioned at 90° from that illustrated in FIG. 1 and connected directly to the underside of the lifter bar 28 so as to raise the bar directly without the need of the cam follower arrangement 40, 42. Indeed means other than a "stepper" motor could be provided to raise the bar or its equivalent.

What I claim is:

1. A yarn package traverse mechanism for a yarn winding machine, for winding a yarn package onto a bobbin having spaced-apart flanges, said mechanism comprising, a rotatable bobbin mount comprising a spindle for receiving said flanged bobbin, said spindle having an axis of rotation, a traverse screw and follower mounted in a traverse box, said traverse box being mounted in an immobile position on said machine, said traverse screw having a first reciprocating drive means and said follower being positioned by said traverse screw to reciprocate along the length of a yarn package, a traverse yarn guide pivotally mounted on said follower and extending over said yarn package, said yarn guide being adapted to pivot away from said axis in a direction perpendicular thereto, lifting means for determining the pivotal position of said yarn guide relative to said axis, said lifting means being independent of said bobbin and said spindle, said lifting means comprising a vertically displaceable member adapted to lift said yarn guide, and control means operatively connected with said lifting means, said control means being adapted to control movement of said yarn guide away from said axis during the winding of said package whereby a small gap is maintained between said traverse yarn guide and the package surface during winding of at least a part of said package, said control means thereby not allowing any part of said mechanism to contact said package surface.

2. A yarn package traverse mechanism as set forth in claim 1 said vertically displaceable member comprising a lifting bar mounted on said machine, said lifting bar being positioned to cooperate with said yarn guide for lifting said yarn guide away from said package axis, said lifting bar being adapted to move in an operative motion path, and said control means comprising a cam surface and a cam follower operatively cooperating with said lifting bar, said cam surface and cam follower cooperating to control the spaced position of said yarn guide relative to said package axis, as determined by the longitudinal position of said lifting bar in its operative motion path.

3. A yarn package traverse mechanism as set forth in claim 1, said vertically displaceable member comprising a lifting bar mounted on said machine, said lifting bar being positioned to cooperate with said yarn guide for maintaining said yarn guide in a spaced relation to said package surface, said lifting bar being adapted to move in an operative motion path, and said control means comprising a stepping motor operatively connected with said lifting bar, said motor being intermittently operable to change the position of said lifting bar at which it cooperates with said yarn guide and, thereby, to change the spaced position of said yarn guide, the operating position of said lifting bar being determined by its longitudinal position in its operating motion path.

4. A yarn package traverse mechanism as set forth in claim 3 said mechanism comprising at least one flange sensing member connected to said yarn guide, said flange sensing member being positioned to contact said bobbin's flanges at the end of each traverse stroke by said yarn guide, said stepping motor being operated intermittently in response to that contact.

5. A yarn traverse mechanism for a yarn winding machine adapted to wind yarn on a flanged bobbin, said mechanism comprising a traverse screw and follower mounted in a traverse box, said traverse box being mounted in an immobile position on said machine, a rotating bobbin mount comprising a spindle having an axis of rotation, a traverse yarn guide pivotally mounted on said follower for movement away from said axis in a plane perpendicular thereto, said yarn guide thereby being adapted to reciprocate along the length of said flanged bobbin for forming a yarn package thereon, said yarn guide comprising two fingers between which yarn is fed, said fingers being pivotally mounted on said follower and being capable of pivotal movement in a direction perpendicular to said axis together or independent of each other, lifting means for determining the instantaneous pivotal position of said yarn guide relative to said axis, said lifting means being independent of said bobbin and said spindle, said lifting means comprising a vertically displaceable member adapted to lift said yarn guide, control means operatively associated with said vertically displaceable member for maintaining a small gap between said guide fingers and the surface of said yarn package being wound on said bobbin so that no part of said yarn guide contacts the package surface, and means for moving the leading one of said guide fingers clear of said bobbin's flange at the end of each traverse stroke by said yarn guide so that the trailing one of said guide fingers may guide said yarn right up to that flange.

6. A yarn traverse mechanism as set forth in claim 5 said moving means comprising a fixed cam associated with said traverse box, said cam being adapted to be engaged by each leading guide finger for pivoting said leading finger to said position beyond the exterior periphery of said flange so that said leading finger may pass over said flange as said yarn guide completes a traverse stroke.

7. A yarn traverse mechanism as set forth in claim 6 further comprising flange sensing means mounted on each guide finger, each said flange sensing means being adapted to detect a bobbin flange proximate to said finger, the flange sensing means on said trailing guide finger causing a signal to be transmitted for reversing said traverse mechanism when said trailing finger's flange sensing means detects the proximity of a bobbin-flange.

8. A yarn traverse mechanism as set forth in claim 6 further comprising flange sensing means adapted to detect a bobbin's flange when proximate to said finger, said flange sensing means on said trailing guide finger causing a signal to be transmitted for reversing said traverse mechanism when said trailing finger's flange sensing means detects the proximity of a bobbin's flange.

9. A yarn traverse mechanism for a yarn winding machine adapted to wind yarn on a flanged bobbin, said mechanism comprising a rotating bobbin mount comprising a spindle having an axis of rotation, a traverse yarn guide support means and a yarn guide mounted on said machine, said traverse yarn guide support means including a yarn guide support member for reciprocal translatory movement parallel to said axis, said yarn guide being pivotally mounted on said support member for pivotal movement in a direction perpendicular to said axis, and said yarn guide having two guide fingers between which said yarn is located, the trailing guide finger in each traverse stroke being operable to cause yarn to be laid up to one flange of said bobbin, a displacement device cooperating with said yarn guide for alternately moving each guide finger to a position clear of a respective one of said bobbin's flanges, said displacement device being operable to so move the leading finger in a traverse stroke prior to or when said leading finger reaches a bobbin's one flange so that the trailing finger of said same traverse stroke may move to a position closely adjacent said bobbin's one flange, a flange sensing means connected to each guide finger on the inner edge of that finger, each flange sensing means being adapted to contact a bobbin flange when its associated finger is the trailing finger in a traverse stroke for transmitting a signal to cause that traverse stroke to be reversed, a carrying plate movably mounted on one of said guide fingers, the flange sensing means for said one finger being mounted on said carrying plate, said carrying plate having biasing means so as to be normally retained in an inoperative position at which its flange sensing means does not obstruct that flange sensing means mounted to the other of said guide fingers when that other guide finger's flange sensing means is in its normal position at which it is adapted to contact a bobbin flange, and a follower means connected to said carrying plate and operatively cooperating with deflector means on said other finger, said deflector means being adapted to move said carrying plate from its inoperative position to an open position at which said carrying plate's flange sensing means can contact a bobbin's flange, said deflector means moving said carrying plate to said operative position only when said other guide finger is displaced by said displacement device away from its normal position at which it is adapted to contact a bobbin flange, and said carrying plate being moved back to said inoperative position by said biasing means when said other guide finger is returned to its normal position.

10. A yarn traverse mechanism as set forth in claim 9, said displacement device comprising lifting means to move the relatively leading finger in each traverse stroke to a position beyond the exterior periphery of said bobbin's flange.

11. A yarn traverse mechanism as set forth in claim 9, said flange sensing means functioning to cause signals to be transmitted that operate to reverse the direction of the movement of said yarn guide lengthwise of the package, and to move it outwardly of the surface of the package to maintain a small gap between said yarn guide and said package surface.

12. A yarn package traverse mechanism for a yarn winding machine for winding a yarn package onto a bobbin having spaced-apart flanges, said mechanism comprising a rotatable bobbin mount comprising a spindle for receiving a said flanged bobbin, said spindle having an axis of rotation, a traversable yarn guide means comprising a yarn guide support means and a yarn guide extending over said yarn package, said yarn guide support means including a yarn guide support member for reciprocal translatory movement parallel to said axis, and said yarn guide being pivotally mounted on said support member for pivotal movement in a direction perpendicular to said axis, first reciprocating drive means for linearly displacing said support member and said yarn guide in a direction parallel to said axis, lifting means for determining the instantaneous pivotal position of said yarn guide relative to said axis, said lifting means being independent of said bobbin and said bobbin's spindle, said lifting means comprising a vertically displaceable member adapted to lift said yarn guide, and second drive means for vertically displacing said displaceable member relative to said support member, said yarn guide being progressively pivoted away from said axis as the diameter of said yarn package increases so as to maintain a small gap between said yarn guide and the surface of said yarn package during winding of at least part of said package, thereby avoiding contact between said yarn guide and said package surface.

13. A yarn package traverse mechanism as set forth in claim 12, said vertically displaceable member comprising a lifting bar in said machine positioned to cooperate with said yarn guide along said length of a yarn package for maintaining said yarn guide in a spaced relation to said package surface, and said second drive means comprising a stepping motor operatively cooperating with said lifting bar to change the position of the lifting bar in a direction normal to the direction of reciprocation of the yarn guide and thereby change the position of the said yarn guide so as to maintain the spaced relationship between the yarn guide and the package surface.

14. A yarn package traverse mechanism as set forth in claim 12, said yarn guide comprising two fingers between which yarn is fed, said fingers each being pivotally mounted on said support member, and said fingers each being capable of pivotal movement in said direction together or independently of each other, and means for moving the leading one of said fingers clear of said bobbin's flange at the end of each traverse stroke by said yarn guide so that the trailing one of said fingers may guide said yarn right up to that flange.

15. A yarn package traverse mechanism as set forth in claim 14 said moving means comprising a fixed linear cam means adapted to be engaged by each leading guide finger for pivoting said leading finger to a position beyond the exterior periphery of said flange to that said leading finger may pass over said flange as said yarn guide completes a traverse.

* * * * *